US005582292A

United States Patent [19]

Cabe

[11] Patent Number: 5,582,292

[45] Date of Patent: Dec. 10, 1996

[54] JUMP ROPE STORAGE

[76] Inventor: Conrad W. Cabe, 1404 E. Buckley, Brownfield, Tex. 79316-6002

[21] Appl. No.: 317,743

[22] Filed: Oct. 4, 1994

[51] Int. Cl.[6] ..... B65D 85/20

[52] U.S. Cl. ..... 206/315.1; 206/579; 206/702

[58] Field of Search ..... 206/49, 315.1, 206/579, 702; 220/661, 743, 773; 482/82; 211/60.1, 61; 242/170, 172; 248/49, 56, 89, 90; 222/575

[56] References Cited

U.S. PATENT DOCUMENTS

| | | | |
|---|---|---|---|
| 921,902 | 5/1909 | Smith | 43/57.3 |
| 2,242,509 | 5/1941 | Coalson | 43/31 |
| 2,851,168 | 9/1958 | Mason et al. | 211/60.1 |
| 2,881,947 | 4/1959 | Hancock | 211/60.1 |
| 3,104,778 | 9/1963 | Leonard | 211/61 |
| 3,703,783 | 11/1972 | Pool | 43/54.5 A |
| 4,209,085 | 6/1980 | Kozan | 206/315.1 |
| 4,475,649 | 10/1984 | Haarbosch | 206/702 |
| 4,735,313 | 4/1988 | Schoenberg | 206/427 |
| 4,979,614 | 12/1990 | Ruhaut | 206/702 |
| 5,147,119 | 9/1992 | Harris . | |
| 5,251,781 | 10/1993 | Skelton | 220/773 |
| 5,386,910 | 2/1995 | Liss | 206/554 |

*Primary Examiner*—David T. Fidei
*Attorney, Agent, or Firm*—Wendell Coffee

[57] ABSTRACT

A dispenser for storing and dispensing jump ropes includes a container having a longitudinal slot that runs over a substantial length of the container. A handle and the rope of a jump rope are placed in the container, and the other handle of the jump rope is placed in the slot of the container.

8 Claims, 1 Drawing Sheet

JUMP ROPE STORAGE

CROSS REFERENCE TO RELATED APPLICATION

None, however, applicant filed Disclosure Document Number 358644 on Aug. 1, 1994, which document concerns this application; therefore, by separate paper it is respectfully requested that the document be retained and acknowledgment thereof made by the Examiner.

BACKGROUND OF THE INVENTION (1) Field of the Invention

This invention relates to gym class equipment, and more particularly to a dispenser for jump ropes. Middle school coaches have ordinary skill in this art.

(2) Description of Related Art

When jump ropes are used for a physical education class, it is often necessary to dispense thirty or more jump ropes for the class. Between classes, it is necessary to store the jump ropes. Typically, jump ropes are stored in bags or boxes. When a class begins, the jump ropes usually are tangled. Excessive time is wasted untangling the thirty jump ropes so that each user has a jump rope to use.

SUMMARY OF THE INVENTION (1) Progressive Contribution to the Art

I have invented a method of storing and dispensing jump ropes, and equipment for that purpose. The jump rope dispenser includes a container with a slot running over a substantial length of the container. The slot's width is sized so that a handle of a jump rope fits within the slot. To store a jump rope, one handle and the rope of the jump rope are placed in the container, while the other handle of the jump rope is placed within the slot and moved to the bottom of the slot.

To dispense a jump rope, the user grabs a handle of a jump rope that is within the slot, removes it from the slot, and moves the handle away from the jump rope dispenser until the jump rope is separated from the other jump ropes and removed from the dispenser.

(2) Objects of this Invention

An object of this invention is store, transport, and disperse jump ropes easily.

A further object is to provide storage, transportation, and dispersing for jump ropes that will not result in tangling of the jump ropes.

Further objects are to achieve the above with a device which is simple, efficient, light-weight, sturdy, compact, durable, safe, versatile, ecologically compatible, energy conserving and reliable; yet is inexpensive and easy to manufacture and maintain.

Other objects are to achieve the above with a method that is simple, rapid, versatile, efficient, and inexpensive.

The specific nature of the invention, as well as other objects, uses, and advantages thereof, will clearly appear from the following description and from the accompanying drawings, the different views of which are not necessarily scale drawings.

Figures 1, 2, 3:
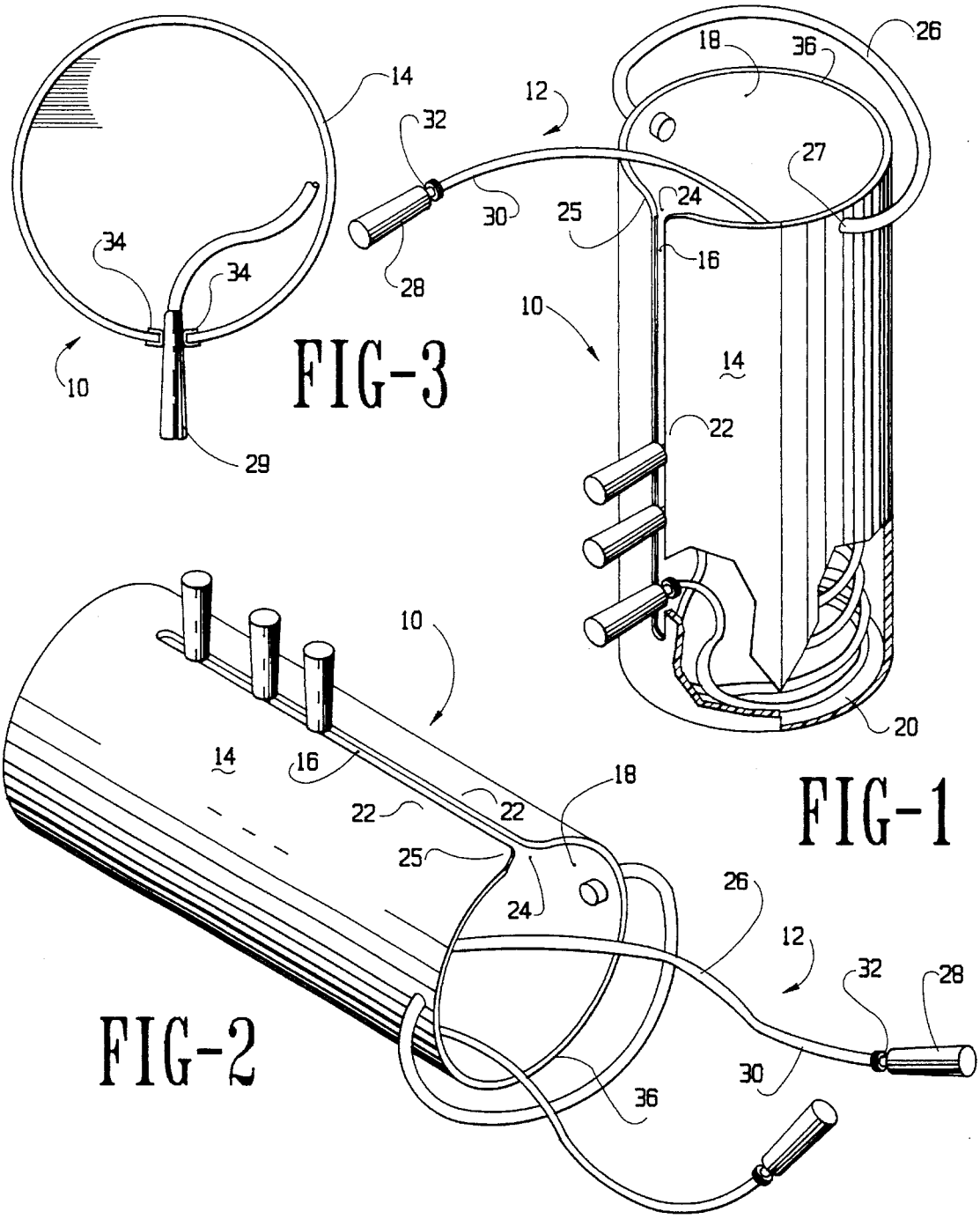
FIG. 1 is a perspective view of a first embodiment of this invention with the container partially broken away to show details of construction.
FIG. 2 is a perspective view of the first embodiment showing jumps ropes being removed.
FIG. 3 is a top plan view of a second embodiment.

As an aid to correlating the terms of the claims to the exemplary drawings the following catalogue of elements is provided:

10—jump rope dispenser
12—jump rope
14—container
16—slot
18—top of container
20—bottom of container
22—slot sides
24—open end of slot
25—rounded end of slot
26—container handle
27—hole
28—grooved jump rope handle
29—cylindrical jump rope handle
30—rope
32—jump rope handle groove
34—rubber strip
36—opposite side to the slot

DESCRIPTION OF THE PREFERRED EMBODIMENTS

With reference to the drawings, the jump rope dispenser is designated generally as 10, and a jump rope is designated generally as 12. The jump rope dispenser is capable of storing and dispensing jump ropes for a physical education class and all other situation where multiple jump ropes are used.

The jump rope dispenser includes container 14 having slot 16 in the container. The container has a uniform width, and this width is less than the length of the container. The container has open top 18 and closed bottom 20. The container is made of a substantially rigid material. As shown in FIG. 1, the container is made from a piece of heavy duty polyvinylchloride (PVC) pipe.

The slot 16 in the container 14 runs a substantial length of the container. The slot has substantially rigid longitudinal sides 22, and the slot has open end 24. The open end of the slot opens at the open top 18 of the container. The open end of the slot has flared or rounded ends 25 for guiding the jump rope 12 into the slot.

The jump rope container 14 also includes handle 26. The handle allows the dispenser to be carried efficiently. As shown in FIGS. 1 and 2, the container handle is a rope that passes through two holes 27 in the container. A knot is at each end of the rope.

A jump rope 12 consists of two handles with rope 30 between the two handles. Handles of jump ropes come in many different styles. The jump rope dispenser is capable of storing jump ropes that have handles that are substantially similar. The jump ropes for a physical education class will be similar, therefore, the jump ropes will have substantially the same handle width, and the handles will fit in slot 16 of the jump rope holder 10.

Grooved jump rope handles 28, such as those shown in FIGS. 1 and 2 are preferred because such handles can be easily inserted into slot 16 at groove 32 of the handle 28. The groove width is less than the slot width, and the slot width is less than the handle width. This prevents the handle from sliding out of the slot in a direction normal to the slot. If the handles do not have such a groove, such as cylindrical handle 29, shown in FIG. 3, the sides of the slot can be covered with a resilient frictional material, such as a rubber strip 34, to prevent the handle from sliding out of the slot in a direction normal to the slot.

To store a jump rope 12 in the dispenser 10, the user places one of the jump rope handles 28 and the rope 30 into the container 14. The user then places the other handle in the slot 16 and moves the handle in the slot away from the open end 24 of the slot. This process is repeated with a plurality of jump ropes until all the jump ropes of a physical education class are stored.

To remove a jump rope from the dispenser 10, the user grabs the handle 28 of a jump rope 12 that is closest to the open end 24 of the slot 16. The user slides the handle along the slot until the handle is free of the slot. Then, the user moves the handle away from the dispenser until the rope 30 and the other handle are separated from all other ropes and are removed from the dispenser.

If the container 14 is upright with the open top 18 up, the jump ropes 10 will be pulled across the top and away from the slot 16 towards side 36 which is opposite to the slot, as seen in FIGS. 1 and 2. Should the container be laid on its side, with the slot up, the ropes are pulled away from the dispenser 10.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A jump rope dispenser in combination with a jump rope having two handles having widths and a rope, said handles being rigid, comprising:

aa) a dispenser having a length and a width;

a) a slot having an open end in said dispenser;

b) said slot defined by longitudinal sides communicating over a substantial length of said dispenser;

c) said sides being substantially rigid;

d) said slot having a width sized to fit the width of a jump rope handle; and e) at least one jump rope handle in the slot.

2. The jump rope dispenser as defined in claim 1 further comprising:

f) a handle on said dispenser.

3. The jump rope dispenser as defined in claim 1 in combination with a plurality of jump ropes, each rope having two handles, said ropes each having one handle in said dispenser; and the other handle of each said rope within the slot.

4. The jump rope dispenser as defined in claim 1 wherein said dispenser is substantially rigid.

5. The jump rope dispenser as defined in claim 1 wherein said dispenser has a uniform width and said width is less than said length.

6. The jump rope dispenser as defined in claim 1 further comprising:

h) said dispenser has an open end and a closed bottom; and i) said slot opens at the open end of the dispenser.

7. A jump rope dispenser for storing jump ropes, each jump rope having two handles having widths and a rope, all of said handles having substantially the same width, comprising:

a) a slot having an open end in said dispenser, b) said slot defined by longitudinal sides communicating over a substantial length of said dispenser;

c) said sides being substantially rigid; and d) said slot having a width sized to fit the width of a jump rope handle; and e) said longitudinal sides of said slot covered with a frictional material to prevent jump rope handles from sliding out of the slot.

8. The jump rope dispenser as defined in claim 7 further comprising:

f) said dispenser being a portion of a container;

g) said sides of the slot being a portion of said container;

h) said container being substantially rigid;

j) said container having a length and a uniform width, said length being greater than said width;

k) said container having an open end and a closed bottom;

l) said slot opens at the open end of the container;

m) a plurality of jump ropes in said container, each rope having two handles, i) one of said handles of each rope in the slot, and ii) the other said handles of each rope in the container.

* * * * *